US006578954B2

(12) United States Patent
Okuda et al.

(10) Patent No.: US 6,578,954 B2
(45) Date of Patent: Jun. 17, 2003

(54) INK JET PRINTING HEAD AND INK JET PRINTING DEVICE ENABLING STABLE HIGH-FREQUENCY INK DROP EJECTION AND HIGH-SPEED PRINTING

(75) Inventors: Masakazu Okuda, Tokyo (JP); Toshinori Ishiyama, Tokyo (JP); Atsushi Murakami, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/118,805

(22) Filed: Apr. 9, 2002

(65) Prior Publication Data

US 2002/0171711 A1 Nov. 21, 2002

(30) Foreign Application Priority Data

Apr. 19, 2001 (JP) ..... 2001-121604

(51) Int. Cl.[7] ..... B41J 2/045
(52) U.S. Cl. ..... 347/70
(58) Field of Search ..... 347/68–72

(56) References Cited

U.S. PATENT DOCUMENTS 4,546,362 A * 10/1985 Koto ..... 347/70

FOREIGN PATENT DOCUMENTS

| | | |
|---|---|---|
| JP | 52-49034 | 4/1977 |
| JP | 53-12138 | 4/1978 |
| JP | 56-75863 | 6/1981 |
| JP | 59-26269 | 2/1984 |
| JP | 9-141864 | 6/1997 |
| JP | 10-193587 | 7/1998 |

* cited by examiner

*Primary Examiner*—John Barlow
*Assistant Examiner*—Michael S. Brooke
(74) *Attorney, Agent, or Firm*—Scully, Scott, Murphy & Presser

(57) ABSTRACT

An ink jet printing head includes a common ink channel and a plurality of ejectors (each of which includes a nozzle and a pressure generation chamber which is filled with ink supplied from the common ink channel) which are connected to the common ink channel for ejecting ink drops. The common ink channel is provided with an air damper, and acoustic capacitance $C_p$ of the common ink channel per ejector is set based on acoustic capacitance $C_n$ of the nozzle and acoustic capacitance $C_c$ of the pressure generation chamber. For example, the acoustic capacitance $C_p$ of the common ink channel per ejector is set so as to satisfy two conditions: $C_p>C_n$ and $C_p>20\ C_c$. By such setting of the acoustic capacitance 10 $C_p$, crosstalk between the ejectors, the increase of refill time, and refill time variation between nozzles in simultaneous ink drop ejection are eliminated efficiently, thereby stable high-frequency ink drop ejection is made possible even when a large number of nozzles are connected to the common ink channel and thereby high-speed printing is realized.

28 Claims, 13 Drawing Sheets

INK JET PRINTING HEAD AND INK JET PRINTING DEVICE ENABLING STABLE HIGH-FREQUENCY INK DROP EJECTION AND HIGH-SPEED PRINTING

BACKGROUND OF THE INVENTION

The present invention relates to an ink jet printing head and an ink jet printing device for printing letters, images, etc. on a medium such as paper by ejecting ink drops from nozzles, and in particular, to an ink jet printing head and an ink jet printing device capable of realizing high-frequency ink drop ejection and high-speed printing.

DESCRIPTION OF THE RELATED ART

In a drop-on-demand ink jet printer, a pressure wave (acoustic wave) is generated in a pressure generation chamber which is filled with ink by use of pressure generation means such as a piezoelectric actuator and thereby an ink drop is ejected from a nozzle that is connected with the pressure generation chamber. Such drop-on-demand ink jet printers are well known today as disclosed in Japanese Publication of Examined Patent Applications No.SH053-12138, Japanese Patent Application Laid-Open No.HEI10-193587, etc.

FIG. 1 is a cross-sectional view showing an example of a printing head of a conventional ink jet printing head. Each pressure generation chamber 121 of the printing head is connected with a nozzle 122 for ejects ink drops and an ink supply channel 124 for guiding ink from an ink tank (unshown) to the pressure generation chamber 121 via a common ink channel 123.

To the bottom of the pressure generation chamber 121, a vibration plate 125 is provided. In order to eject an ink drop, a piezoelectric actuator 126 which is provided outside the pressure generation chamber 121 deforms the vibration plate 125 and thereby changes the volume (capacity) of the pressure generation chamber 121. The change of volume causes a pressure wave in the pressure generation chamber 121 and thereby part of the ink packed in the pressure generation chamber 121 is ejected from the nozzle 122 to outside as an ink drop 127. The ink drop 127 flying from the nozzle 122 reaches a medium such as paper and thereby forms an ink dot. Letters, images, etc. are printed and recorded on the medium by repeating the ink dot formation according to specific image data.

Various types of driving waveforms are applied to the piezoelectric actuator 126 depending on the size of the ink drop 127 to be ejected from the nozzle 122. For the ejection of large-diameter ink drops 127 for printing letters, deep-color parts, etc., a driving waveform as shown in FIG. 2 is generally used. First, the voltage applied to the piezoelectric actuator 126 is raised (voltage increase process 111), thereby the volume of the pressure generation chamber 121 is rapidly decreased and thereby the ink drop ejection is carried out. Thereafter, the voltage is returned to the bias voltage Vb (voltage decrease process 112).

FIG. 3 is a schematic diagram showing the action of a meniscus in a nozzle when the ink drop ejection is carried out. The meniscus 132 which is almost flat in the beginning ((A) of FIG. 3) moves outward as the pressure generation chamber 121 is compressed, and thereby an ink drop 133 is ejected from the nozzle 131 ((B) of FIG. 3). Due to the decrease of ink in the nozzle 131 caused by the ink drop ejection, a concave meniscus 132 is formed in the nozzle 131 ((C) of FIG. 3). The surface of the concave meniscus 132 gradually returns to the nozzle opening due to surface tension of ink and thereafter recovers to the original state, that is, the state before the ink drop ejection ((D), (E) and (F) of FIG. 3).

FIG. 4 is a graph showing the change of position of the meniscus when the ink drop ejection is carried out. As shown in FIG. 4, the meniscus 132 which withdrew widely ($y=-60\ \mu m$) just after the ink drop ejection ($t=0$) returns to the initial position ($y=0$) after vibrating. In this document, the action of the meniscus returning to the initial position after the ink drop ejection will be referred to as "refill", and the time ($t_r$) necessary for the meniscus to return first to the nozzle opening surface ($y=0$) after the ink drop ejection will hereafter be referred to as "refill time".

When the repeated and continuous ink drop ejection is carried out by an ink jet printing head, if an ink drop is ejected before the refill after the previous ink drop ejection is completed, the uniformity of the diameter and speed of ink drops is deteriorated and thereby the continuous ink drop ejection becomes unstable. In other words, stable ink drop ejection is impossible until a time $t_r$ or more elapses after the previous ink drop ejection. Therefore, the refill time $t_r$ is a critical characteristic value dominating the maximum ejection frequency (printing speed) of an ink jet printing head.

Besides the refill time $t_r$, the number of nozzles also dominates the printing speed. As the number of nozzles increases, the number of dots that can be formed in a unit time increases and thereby the printing speed increases. Therefore, in ordinary ink jet printers of these days, a multi-nozzle printing head, having a plurality of ink drop ejection mechanisms (ejectors) which are connected together, is generally employed.

FIG. 5 is a schematic diagram showing the basic composition of a multi-nozzle ink jet printing head. An ink tank 157 is connected with a common ink channel 153. To the common ink channel 153, a plurality of pressure generation chambers 151 are connected via ink supply channels (unshown). By such composition, the ink drop ejection can be carried out from a plurality of ejectors at the same time and thereby the printing speed can be increased.

However, in order to realize stable ink drop ejection in such a multi-nozzle ink jet printing head, the common ink channel has to be designed properly, that is, pressure wave interference (crosstalk) etc. between the ejectors (which are connected with the common ink channel) has to be eliminated. Therefore, some methods for preventing the crosstalk between the ejectors by enlarging the acoustic capacitance of the common ink channel have been proposed so far.

For example, in an ink jet printing head disclosed in Japanese Patent Application Laid-Open No.SHO56-75863 (hereafter, referred to as "prior art #1"), the capacity of the common ink channel is set to more than twice as large as the total capacity of the pressure generation chambers (including nearby channels) and thereby the crosstalk is suppressed.

In Japanese Patent Application Laid-Open No.SHO52-49034 and Japanese Patent Application Laid-Open No.HEI9-141864, pressure damping means (air damper, pressure absorber, etc.) is provided to the common ink channel in order to realize a large acoustic capacitance even in a common ink channel of a limited capacity.

In Japanese Patent Application Laid-Open No.SHO59-26269 (hereafter, referred to as "prior art #2"), based on the number (N) of ejectors connected with the common ink channel and the impedance ($Z_S$) of the ink supply channel, the impedance ($Z_R$) of the common ink channel is set so as to satisfy a condition $Z_R \leqq Z_S/(10N)$ and thereby the crosstalk is suppressed.

However, according to evaluations of experimentally manufactured multi-nozzle ink jet printing heads which have been performed by the present inventors, it became clear that the conventional ink jet printing heads explained above are not necessarily capable of guaranteeing stable ink drop ejection. The problems with the conventional ink jet printing heads will hereafter be explained referring to some concrete examples.

First, when a plurality of ejectors (which are connected together by the common ink channel) carries out the ink drop ejection simultaneously, the refill time of each ejector increases, and further, variation of refill time occurs between ejectors.

FIG. 6 is a graph showing an experimental result of the refill time of the conventional multi-nozzle ink jet printing head of FIG. 5. In the experiment, a multi-nozzle ink jet printing head having 32 ejectors was used, and the refill time of each ejector was measured under different ejection conditions. An air damper was provided to the common ink channel and thereby the acoustic capacitance of the common ink channel was set large enough to satisfy the conditions of the prior arts #1 and #2. In FIG. 5, the ejectors are numbered from #1 (ejector nearest to the inlet (joint between the ink tube B 155 and the common ink channel 153) of the common ink channel) to #32 (ejector farthest from the inlet).

When each ejector was driven individually and separately, the refill time was almost constant (approximately 50 μs) for all the ejectors as shown by open circles (○) of FIG. 6. On the other hand, when all the 32 ejectors were driven at the same time and the simultaneous ink drop ejection was carried out, the refill time increased as a whole, and the variation of the refill time between ejectors occurred considerably. Concretely, the increase of refill time was relatively small and almost constant in the ejectors #1~#25, whereas the refill time exhibited a rapid increase from the ejector #26. The refill time increased to 65 μs in the ejector #32 at the distal end of the common ink channel.

As above, in the conventional multi-nozzle ink jet printing heads, the refill time tends to increase much in ejectors near the distal end of the common ink channel when the simultaneous ink drop ejection from all the ejectors is carried out. Such phenomenon becomes prominent as the number of ejectors connected to the common ink channel becomes larger.

If such variation of refill time occurs, the maximum ejection frequency of the head is necessitated to be decreased and thereby high-speed printing becomes difficult. In the above example, each ejector should be capable of ejecting ink drops at a frequency of approximately 20 kHz since the refill time of each ejector is 50 μs in the single (separate) ink drop ejection. However, when the simultaneous ink drop ejection (from all the ejectors) is carried out, the refill time of the ejector #32 increases to 65 μs, thereby the maximum ejection frequency in practical use drops to 15 kHz. If the ink drop ejection at 20 kHz is forcibly carried out, the ink drop ejection state becomes very unstable and at worst, the ink drop ejection capabilities of the nozzles are disabled by bubbles taken in the nozzles. Even when the ejection frequency was lowered to 15 kHz, variations of ±15% in the ink drop volume and ±18% in the ink drop speed were observed between the ejectors.

Such variations in the ink drop volume and ink drop speed can be attributed to unevenness of the meniscus initial state ((A) of FIG. 3) between the ejectors which is caused by the refill speed variation between the ejectors. Incidentally, when the simultaneous ink drop ejection from all the nozzles was carried out at a far lower ejection frequency (1 kHz), the variations in the ink drop volume and ink drop speed were both within ±2%, that is, the pressure wave interference (crosstalk) between ejectors was almost perfectly eliminated at the low frequency.

As explained above, in the conventional ink jet printing heads, the refill time increases and the refill time variation between nozzles occurs when the simultaneous ink drop ejection from all the nozzles is carried out, thereby stable ink drop ejection from the nozzles at high frequency becomes difficult. The phenomenon puts limitations both on the number of ejectors and on the ejection frequency, seriously obstructing the improvement of the printing speed of ink jet printers.

Further, as the second problem of the conventional ink jet printing heads, the crosstalk can not necessarily be eliminated even if the common ink channel characteristics (acoustic capacitance, impedance) are adjusted according to conventional techniques. The crosstalk sometimes cause large variations in the ink drop volume and ink drop speed.

FIG. 7A is a graph showing the change of the incidence of crosstalk that was observed by the present inventors when the ratio between the capacity Wp of the common ink channel and the total capacity Wc of the pressure generation chambers (including nearby channels) was changed in the conventional multi-nozzle ink jet printing head of FIG. 5 (having 32 ejectors and no air damper). The incidence of crosstalk was obtained from the variation occurring in the ink drop speed. As is clear from FIG. 7A, crosstalk diminishes as the ratio Wp/Wc increases.

However, FIG. 7A also shows that the crosstalk can not be suppressed perfectly even when the ratio Wp/Wc is set larger than 2 according to the prior art #1. Especially in the range 0.1<Wp/Wc 10, the crosstalk becomes much dominant and the variations in the ink drop volume and ink drop speed amount to 30% or more.

FIG. 7B is a graph showing the change of the ratio $(Z_S/(Z_R \cdot N))$ between supply channel impedance $Z_S$ and common ink channel impedance $Z_R$ that was observed by the present inventors when the ratio Wp/Wc was changed in the ink jet printing head of FIG. 5. In the evaluated head, the ratio $Z_S/(Z_R \cdot N)$ becomes 10 or more when Wp/Wc>6, by which the condition $(Z_R \leqq Z_S/(10N))$ of the prior art #2 is satisfied.

However, crosstalk occurs when Wp/Wc<50 as shown in FIG. 7A, which means that the condition of the prior art #2 is also not a sufficient condition for preventing the crosstalk. The prior art #2 sets the common ink channel impedance $Z_R$ based on the supply channel impedance $Z_S$ only, without taking other factors (acoustic capacitance of the pressure generation chambers, etc.) into consideration.

As explained above, the conventional ink jet printing heads have the second problem of being incapable of necessarily eliminating the crosstalk between the ejectors even if the characteristics and structure of the common ink channel are set properly according to the conventional techniques.

As described above, in the conventional ink jet printing heads, the refill time increases and the refill time variation between nozzles occurs when the simultaneous ink drop ejection from nozzles is carried out (first problem), and the crosstalk can not be eliminated perfectly (second problem). The problems become critical as the number of ejectors connected to the common ink channel gets larger, by which the realization of high-speed ink jet printing heads becomes difficult.

SUMMARY OF THE INVENTION

It is therefore the primary object of the present invention to provide an ink jet printing head and an ink jet printing device by which the crosstalk and the increase of the refill time occurring in the simultaneous ink drop ejection from many ejectors can be avoided and thereby high-speed and high-quality printing can be realized.

In accordance with a first aspect of the present invention, there is provided an ink jet printing head comprising: a plurality of ejectors (each of which at least includes a pressure generation chamber, a nozzle which is connected with the pressure generation chamber, and pressure generation means for generating pressure in the pressure generation chamber); and an ink supply system (which at least includes a common ink channel to which the ejectors are connected), and forming letters, image patterns, etc. on a medium by ejecting ink drops from the nozzles by letting the pressure generation means cause change of pressure in the pressure generation chambers which are filled with ink supplied from the common ink channel. In the ink jet printing head, acoustic capacitance $C_p$ of the common ink channel per ejector is set based on acoustic capacitance $C_n$ of the nozzle and acoustic capacitance $C_c$ of the pressure generation chamber.

In accordance with a second aspect of the present invention, in the first aspect, the acoustic capacitance $C_p$ of the common ink channel per ejector is set so as to satisfy a condition $C_p>10C_n$.

In accordance with a third aspect of the present invention, in the first aspect, the acoustic capacitance $C_p$ of the common ink channel per ejector is set so as to satisfy a condition $C_p>20C_c$.

In accordance with a fourth aspect of the present invention, in the first aspect, the acoustic capacitance $C_p$ of the common ink channel per ejector is set so as to satisfy conditions $C_p>10C_n$ and $C_p>20C_c$.

In accordance with a fifth aspect of the present invention, in the first aspect, the common ink channel is provided with pressure damping means for damping pressure therein.

In accordance with a sixth aspect of the present invention, in the fifth aspect, the pressure damping means is implemented by a resin film.

In accordance with a seventh aspect of the present invention, in the sixth aspect, the pressure damping means is implemented by a polyimide film.

In accordance with an eighth aspect of the present invention, in the fifth aspect, the pressure damping means is formed so that its acoustic capacitance will get larger at the distal end of the common ink channel.

In accordance with a ninth aspect of the present invention, in the eighth aspect, the thickness of the pressure damping means is decreased at the distal end of the common ink channel.

In accordance with a tenth aspect of the present invention, in the eighth aspect, grooves are provided to the pressure damping means at the distal end of the common ink channel.

In accordance with an eleventh aspect of the present invention, in the first aspect, an area to which no ejector is connected is provided to the distal end of the common ink channel.

In accordance with a twelfth aspect of the present invention, in the eleventh aspect, a hole or channel for bleeding bubbles is provided to the distal end of the common ink channel.

In accordance with a thirteenth aspect of the present invention, in the first aspect, the ejectors are arranged in a two-dimensional matrix.

In accordance with a fourteenth aspect of the present invention, in the thirteenth aspect, the common ink channel includes: a common ink channel mainstream as the upstream side of the common ink channel; and a plurality of common ink channel tributaries which are connected to the common ink channel mainstream as the downstream side of the common ink channel, to each of which a plurality of ejectors are provided.

In accordance with a fifteenth aspect of the present invention, there is provided an ink jet printing device employing an ink jet printing head that comprises: a plurality of ejectors (each of which at least includes a pressure generation chamber, a nozzle which is connected with the pressure generation chamber, and pressure generation means for generating pressure in the pressure generation chamber); and an ink supply system (which at least includes a common ink channel to which the ejectors are connected), and that forms letters, image patterns, etc. on a medium by ejecting ink drops from the nozzles by letting the pressure generation means cause change of pressure in the pressure generation chambers which are filled with ink supplied from the common ink channel. In the ink jet printing head of the ink jet printing device, acoustic capacitance $C_p$ of the common ink channel per ejector is set based on acoustic capacitance $C_n$ of the nozzle and acoustic capacitance $C_c$ of the pressure generation chamber.

In accordance with a sixteenth aspect of the present invention, in the fifteenth aspect, the acoustic capacitance $C_p$ of the common ink channel per ejector is set so as to satisfy a condition $C_p>10C_n$.

In accordance with a seventeenth aspect of the present invention, in the fifteenth aspect, the acoustic capacitance $C_p$ of the common ink channel per ejector is set so as to satisfy a condition $C_p>20C_c$.

In accordance with an eighteenth aspect of the present invention, in the fifteenth aspect, the acoustic capacitance $C_p$ of the common ink channel per ejector is set so as to satisfy conditions $C_p>10C_n$ and $C_p>20C_c$.

In accordance with a nineteenth aspect of the present invention, in the fifteenth aspect, the common ink channel is provided with pressure damping means for damping pressure therein.

In accordance with a twentieth aspect of the present invention, in the nineteenth aspect, the pressure damping means is implemented by a resin film.

In accordance with a twenty-first aspect of the present invention, in the twentieth aspect, the pressure damping means is implemented by a polyimide film.

In accordance with a twenty-second aspect of the present invention, in the nineteenth aspect, the pressure damping means is formed so that its acoustic capacitance will get larger at the distal end of the common ink channel.

In accordance with a twenty-third aspect of the present invention, in the twenty-second aspect, the thickness of the pressure damping means is decreased at the distal end of the common ink channel.

In accordance with a twenty-fourth aspect of the present invention, in the twenty-second aspect, grooves are provided to the pressure damping means at the distal end of the common ink channel.

In accordance with a twenty-fifth aspect of the present invention, in the fifteenth aspect, an area to which no ejector is connected is provided to the distal end of the common ink channel.

In accordance with a twenty-sixth aspect of the present invention, in the twenty-fifth aspect, a hole or channel for bleeding bubbles is provided to the distal end of the common ink channel.

In accordance with a twenty-seventh aspect of the present invention, in the fifteenth aspect, the ejectors are arranged in a two-dimensional matrix.

In accordance with a twenty-eighth aspect of the present invention, in the twenty-seventh aspect, the common ink channel includes: a common ink channel mainstream as the upstream side of the common ink channel; and a plurality of common ink channel tributaries which are connected to the common ink channel mainstream as the downstream side of the common ink channel, to each of which a plurality of ejectors are provided.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Figure 1:
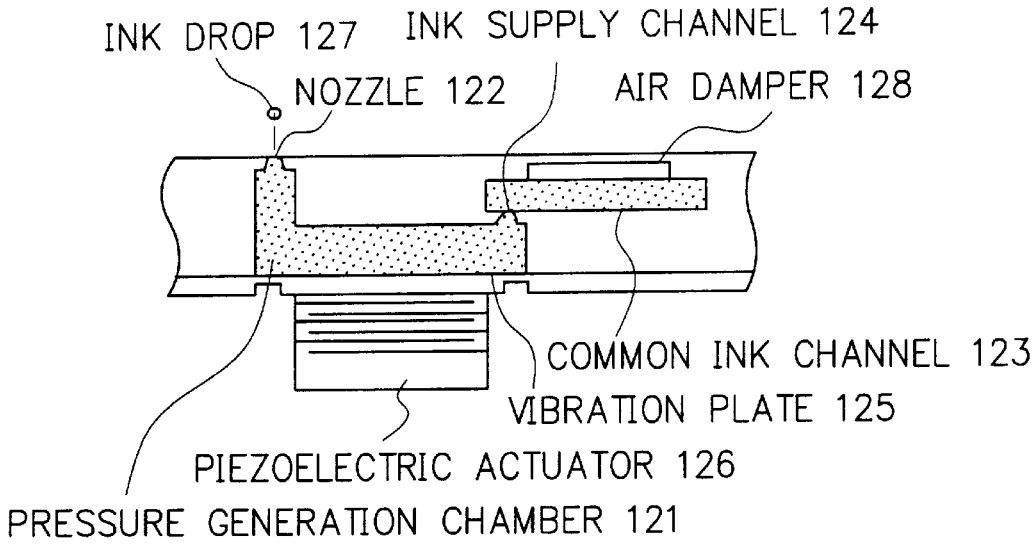
FIG. 1 (PRIOR ART)
FIG. 1 is a cross-sectional view showing an example of a printing head of a conventional ink jet printing head.
Figure 2:
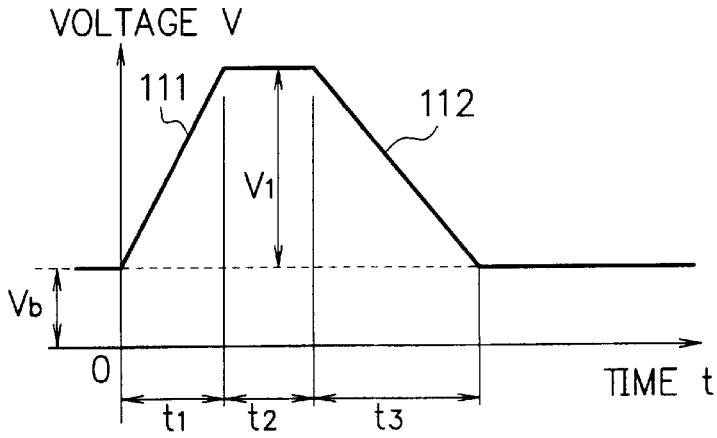
FIG. 2 (PRIOR ART)
FIG. 2 is a graph showing an example of a driving waveform of an ink jet printing head.

Referring now to the drawings, a description will be given in detail of preferred embodiments in accordance with the present invention.

First, the principles and effects of the ink jet printing head of the present invention will be explained referring to equivalent circuits of FIGS. 8, 9 and 10.

Figure 8:
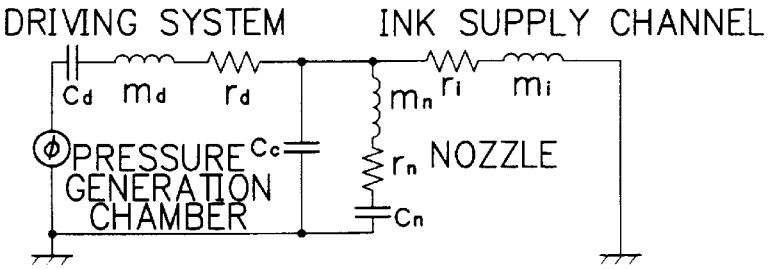
FIG. 8 is a circuit diagram showing a circuit that is equivalent to an ejector of the ink jet printing head of FIG. 1.

FIG. 8 is a circuit diagram showing a circuit that is equivalent to an ejector of the ink jet printing head of FIG. 1, wherein "m" denotes inertance [kg/m$^4$], "r" denotes acoustic resistance [Ns/m$^5$], "c" denotes acoustic capacitance [m$^5$/N], and "ϕ" denotes pressure [Pa]. A subscript "d" which is used in FIG. 8 means a driving system, "c" means a pressure generation chamber, "i" means an ink supply channel, and "n" means a nozzle.

A multi-nozzle ink jet printing head includes a plurality of ejectors of FIG. 8 which are connected together by a common ink channel. An equivalent circuit of such a multi-nozzle ink jet printing head is shown in FIG. 9, wherein a subscript "p" means a common ink channel, "s" means an ink supply system other than the common ink channel.

Figure 9:
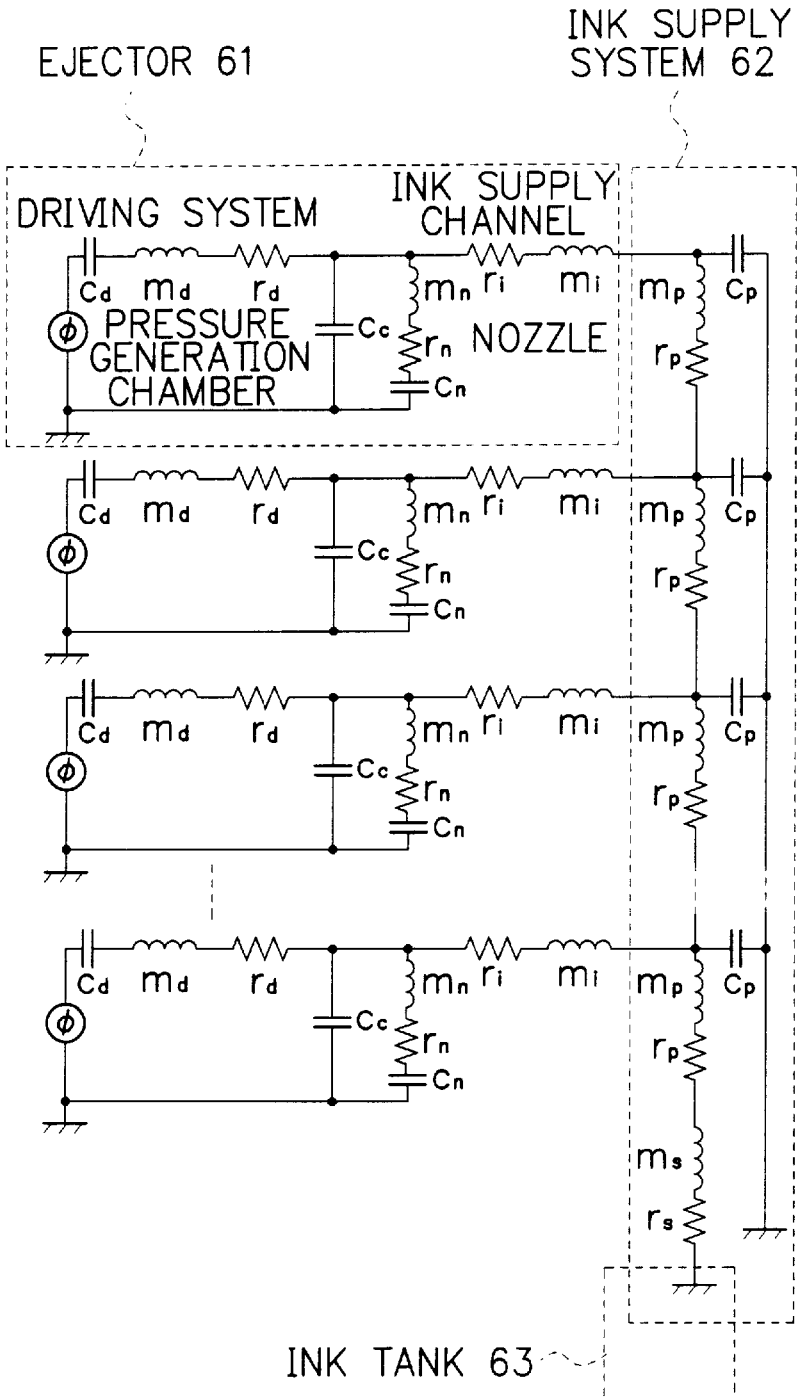
FIG. 9 is a circuit diagram showing an equivalent circuit of a multi-nozzle ink jet printing head.
Figure 10:
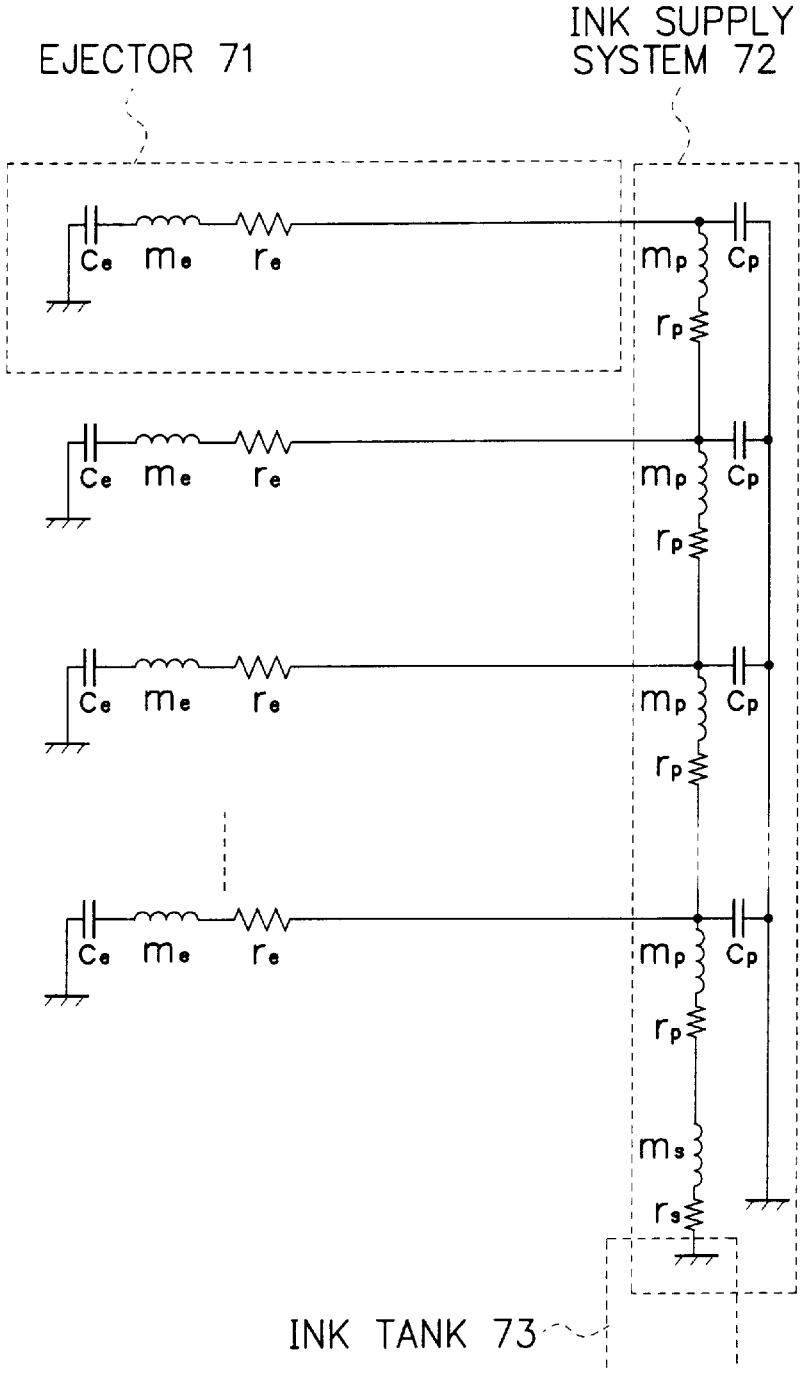
FIG. 10 is a circuit diagram showing a simplification of the equivalent circuit of FIG. 9 in refill operation.

In the refill operation, the equivalent circuit of FIG. 9 can be simplified as FIG. 10 ($m_e=m_i+m_n$, $r_e=r_i+r_n$). Incidentally, $C_p$, $m_p$ and $r_p$ are values for each ejector. For example, when the total acoustic capacitance of the common ink channel is $1\times10^{-17}$ m$^5$/N and 10 ejectors are evenly connected to the common ink channel, the acoustic capacitance $C_p$ (for each ejector) is $0.1\times10^{-17}$ m$^5$/N. When the ejectors are not placed evenly, the total acoustic capacitance of the common ink channel is properly distributed to each ejector depending on the placement of the ejectors.

There are three functions that are required of the common ink channel: (A) generating a normal pressure wave in the pressure generation chamber of each ejector; (B) preventing pressure wave interference (crosstalk) between the ejectors; and (C) preventing the increase of refill time in the simultaneous ink drop ejection. In the following, characteristics that are required of the common ink channel for realizing the above three functions will be discussed.

First, a condition for realizing the function (A) will be considered. As is clear from the equivalent circuit of FIG. 9, when the acoustic capacitance $C_p$ of the common ink channel is large enough, the equivalent circuit of each ejector section in FIG. 9 can be regarded as equivalent to FIG. 8. In other words, the common ink channel, when seen from each ejector, can be regarded as an ink source having infinite capacity (acoustic capacitance). In such cases, the pressure wave which is generated in the pressure generation chamber is not affected by the common ink channel at all.

Figure 11:
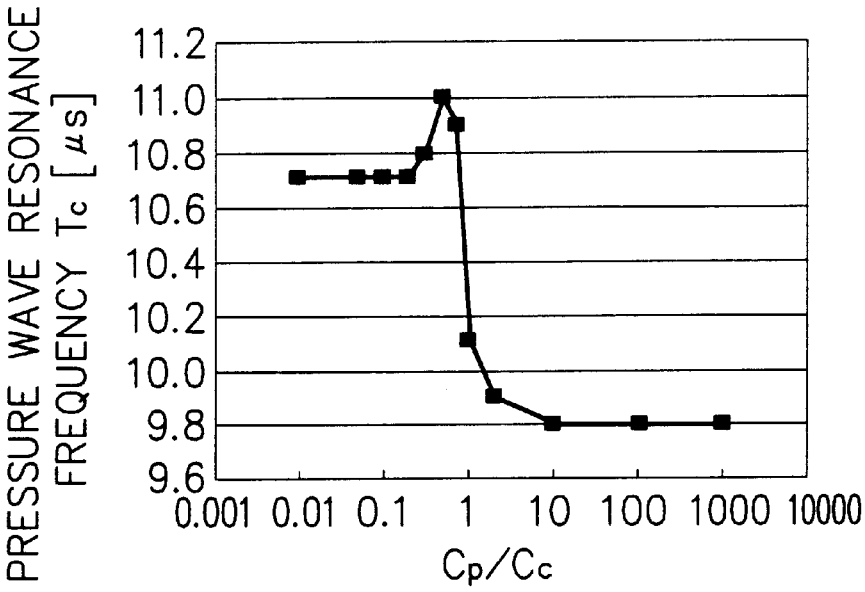
FIG. 11 is a graph showing the change of the natural period (resonance period) Tc of the pressure wave generated in the pressure generation chamber which was observed when the acoustic capacitance $C_p$ of the common ink channel was changed.

FIG. 11 is a graph showing the change of the natural period (resonance period) Tc of the pressure wave generated in the pressure generation chamber which was observed by the present inventors when the acoustic capacitance $C_p$ was changed in trial-product heads ($C_c=2\times10^{-20}$ $m^5/N$). When the ratio $C_p/C_c$ gets larger than a specific ratio, the pressure wave natural period Tc becomes constant and the effect of the common ink channel disappears.

The present inventors further conducted similar evaluations for a plurality of heads changing other characteristic values such as $m_p$ and $r_p$ and found out that the influence of the common ink channel on the pressure wave generated in the pressure generation chamber can be eliminated and the function (A) (i.e. generation of a normal pressure wave in the pressure generation chamber) can be realized if the following condition (1) is satisfied.

$$C_P>10C_c \quad (1)$$

Next, a condition for realizing the function (B) (i.e. prevention of pressure wave interference (crosstalk) between the ejectors) will be considered. For this purpose, it is necessary to set the characteristics of the common ink channel so as to minimize pressure wave propagation between the ejectors through the common ink channel. The present inventors conducted the trial production and evaluation of a great number of heads and carried out equivalent-circuit analysis using the circuit of FIG. 9, and could make it clear that the incidence of crosstalk depends mostly on the ratio between $C_p$ and $C_c$.

Figure 12:
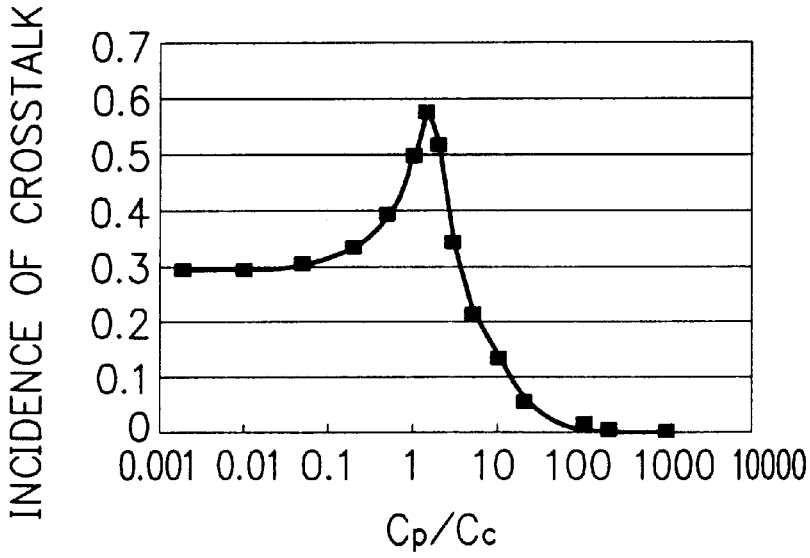
FIG. 12 is a graph showing the relationship between the incidence of crosstalk and a ratio $C_p/C_c$ which was studied by the present inventors.

FIG. 12 is a graph showing the relationship between the incidence of crosstalk and the ratio $C_p/C_c$ which was studied by the present inventors. Incidentally, the incidence of crosstalk was evaluated based on (v2-v1)/v1, in which "v1" denotes the ink drop speed when the single ink drop ejection was carried out by a single ejector and "v2" denotes the ink drop speed when the simultaneous ink drop ejection was carried out by all the ejectors. FIG. 12 shows that the incidence of crosstalk can be reduced by increasing the ratio $C_p/C_c$, in which the incidence becomes 10% or less if the following condition (2) is fulfilled.

$$C_p>20C_c \quad (2)$$

FIG. 12 also shows that the incidence of crosstalk gets very large in a range $0.1<C_p/C_c<10$. The result can be attributed to a kind of pressure wave resonance. A pressure wave occurs in the common ink channel due to pressure wave propagation from the pressure generation chamber. In the range $0.1<C_p/C_c<10$, the frequency of the pressure wave in the common ink channel gets closer to the frequency of the pressure wave in the pressure generation chamber, thereby a kind of resonance occurs between the pressure waves and thereby the crosstalk increases.

Strictly speaking, the inertance $m_p$ and the acoustic resistance $r_p$ of the common ink channel also have effects on the incidence of crosstalk. However, the effects are very small in ordinary ink jet printing heads. Therefore, the ratio $C_p/C_c$ can be regard as dominating the incidence of crosstalk.

The crosstalk could not be eliminated perfectly in the conventional ink jet printing heads since the characteristics of the common ink channel were not optimized based on the ratio $C_p/C_c$, being unaware of the rapid increase of crosstalk in a specific range of the ratio $C_p/C_c$ ($0.1<C_p/C_c<10$).

As above, the condition (2) (i.e. $C_p>20C_c$) has to be fulfilled in order to realize the function (B). The condition (2) is included in the aforementioned condition (1) (i.e. $C_p>10C_c$). Therefore, the condition (2) ($C_p>20C_c$) is the necessary condition for realizing both the functions (A) and (B).

Next, a condition for realizing the function (C) (i.e. reduction of the increase of refill time in the simultaneous ink drop ejection) will be considered. For this purpose, it is necessary to optimize the characteristics of the common ink channel by use of the equivalent circuit of FIG. 10.

We can find no documents or examples so far that have studied the function (C) in detail. With regard to the function (C), the present inventors conducted equivalent-circuit analysis and trial production and evaluation of heads, and could make it clear that the refill time variation in the simultaneous ink drop ejection depends on the ratio between $C_p$ and $C_n$.

Figure 13:
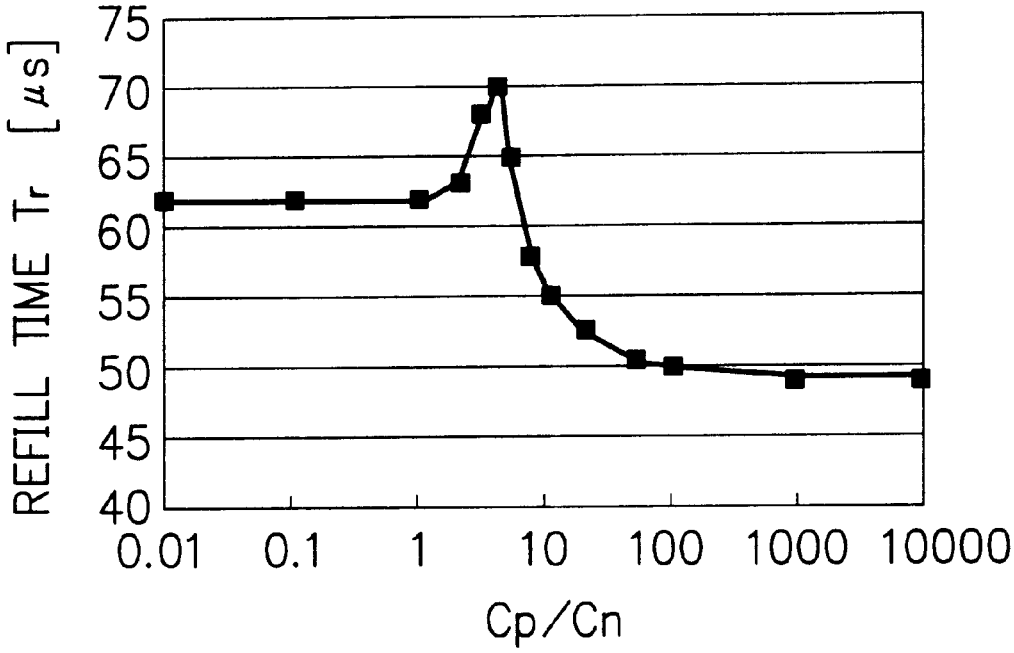
FIG. 13 is a graph showing the relationship between the refill time $t_r$ and a ratio $C_p/C_n$ which was studied by the present inventors.

FIG. 13 is a graph showing the relationship between the refill time $t_r$ and the ratio $C_p/C_n$ which was studied by the present inventors ($C_n=8.5\times10^{-19}$ $m^5/N$). FIG. 13 shows that the refill time $t_r$ can be reduced by increasing the ratio $C_p/C_n$. The present inventors could make it clear that the increase of refill time can be prevented and the refill time variation between ejectors can be eliminated by setting the ratio $C_p/C_n$ larger than 10 (that is, by satisfying a condition $C_p>10C_n$).

FIG. 13 also shows that the increase of refill time gets abnormally large in a range $4<C_p/C_n<10$. The result can also be attributed to the interference (resonance) between the pressure wave in the common ink channel and the pressure wave in the pressure generation chamber, similarly to the case of the crosstalk. Therefore, in the designing of multi-nozzle ink jet printing heads, it is of critical importance to design the common ink channel so as not to satisfy the condition $4<C_p/C_n<10$.

Incidentally, the effects of the inertance $m_p$ and the acoustic resistance $r_p$ of the common ink channel are very little also on the increase of refill time. The trial production of a variety of heads which has been carried out by the present inventors made it cleat that, in ordinary ink jet printing heads, the function (C) can be realized by setting the characteristics of the common ink channel based on the ratio $C_p/C_n$.

As above, guaranteeing enough acoustic capacitance of the common ink channel is critical also for the realization of the function (C). In the conventional ink jet printing heads, the refill time used to increase as the number of ejectors simultaneously ejecting ink drops increased. The phenomenon can be interpreted as the decrease of the acoustic capacitance $C_p$ (assigned to each ejector) which is caused by the increase of the number of simultaneously ejecting ejectors. By the decrease of the acoustic capacitance $C_p$ per ejector, the condition $C_p>10C_n$ could not be satisfied in the conventional ink jet printing heads. Incidentally, in ordinary ink jet printing heads, the acoustic capacitance $C_n$ of the nozzle is 10~20 times as large as the acoustic capacitance $C_c$ of the pressure generation chamber. Therefore, in order to realize the function (C) (prevention of the increase of refill time in the simultaneous ink drop ejection), the common ink channel is required to have acoustic capacitance of 5 to 10 times as large as the acoustic capacitance necessary for the function (B) (prevention of crosstalk).

As discussed above, for realizing the three functions required of the common ink channel: (A) generation of a normal pressure wave in the pressure generation chamber of each ejector; (B) prevention of pressure wave interference (crosstalk) between the ejectors; and (C) prevention of the increase of refill time in the simultaneous ink drop ejection, two conditions: $C_p>10C_n$ and $C_p>20C_c$ have to be satisfied.

The enlargement of the acoustic capacitance $C_p$ of the common ink channel should not be done carelessly. If the acoustic capacitance $C_p$ satisfied $0.1<C_p/C_c<10$ or $4<C_p/C_n<10$, a large increase is caused in the crosstalk or in the increase of refill time.

The ink jet printing head of the present invention is characterized by the optimum setting of the acoustic capacitance $C_p$ of the common ink channel satisfying the two conditions: $C_p>10C_n$ and $C_p>20C_c$ based on the above results. The above three functions: (A) generation of a normal pressure wave in the pressure generation chamber of each ejector; (B) prevention of pressure wave interference (crosstalk) between the ejectors; and (C) prevention of the increase of refill time in the simultaneous ink drop ejection can be attained only by such setting of the acoustic capacitance $C_p$.

In the conventional ink jet printing heads, the capacity (acoustic capacitance) or the impedance of the common ink channel was set based on the capacity (acoustic capacitance) of the pressure generation chamber or the impedance of the ink supply channel. On the other hand, in the ink jet printing head of the present invention, the acoustic capacitance $C_p$ of the common ink channel is set based on the acoustic capacitance $C_n$ of the nozzle and the acoustic capacitance $C_c$ of the pressure generation chamber. Such setting of the present invention is based on the fact that the change of refill time in the simultaneous ink drop ejection from a plurality of ejectors (that is, refill time variation between ejectors and the increase of refill time compared with the single ejection) is dominated by the ratio between $C_p$ and $C_n$ and the fact that the crosstalk is dominated by the ratio between $C_p$ and $C_c$, which have been found out by the present inventors from the great number of ejection observation experiments, fluid analyses, equivalent-circuit analyses, etc. To sum up, the ink jet printing head of the present invention is characterized by the setting of the ratios $C_p/C_n$ and $C_p/C_c$ above specific ratios, thereby stable simultaneous ink drop ejection from a plurality of ejectors can be realized.

In the following, some embodiments in accordance with the present invention will be explained in detail referring to figures.

Embodiment 1

Figure 5:
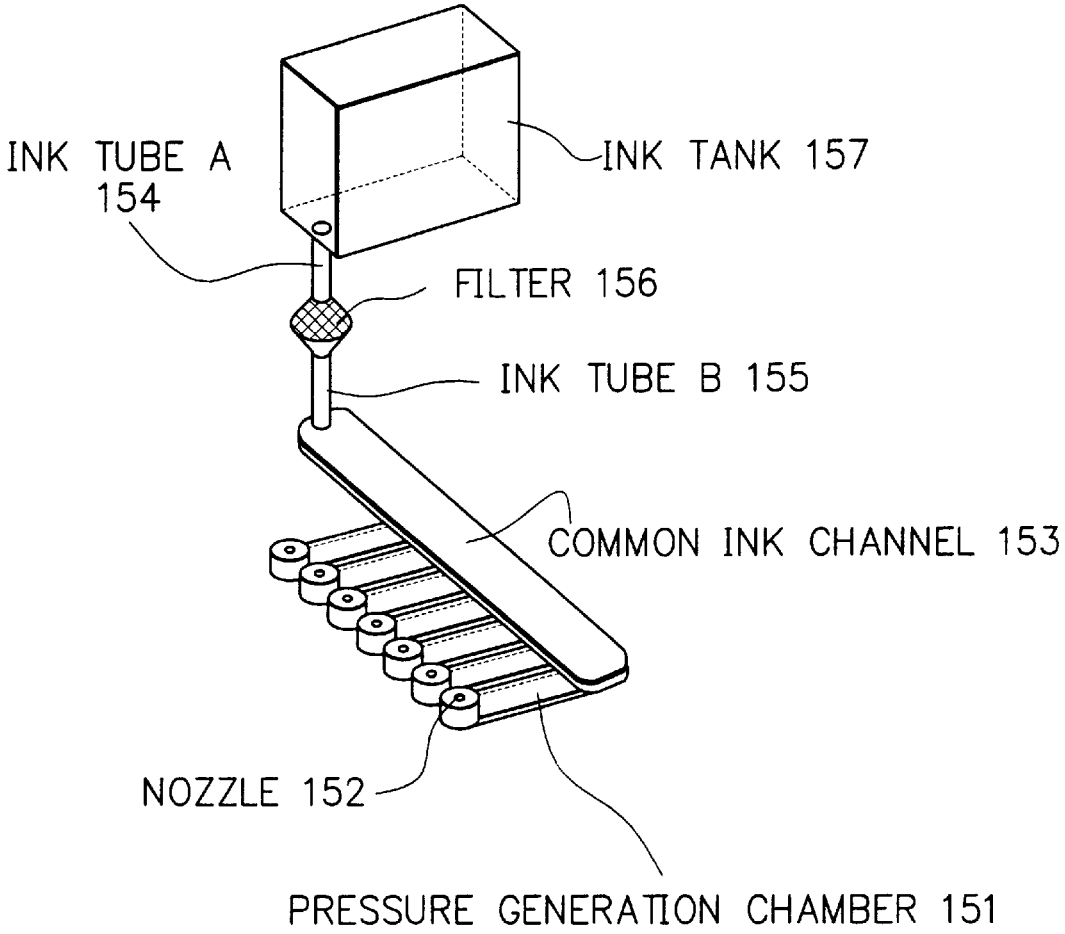
F I G. 5 (PRIOR ART)
FIG. 5 is a schematic diagram showing the basic composition of a multi-nozzle ink jet printing head.
Figure 6:
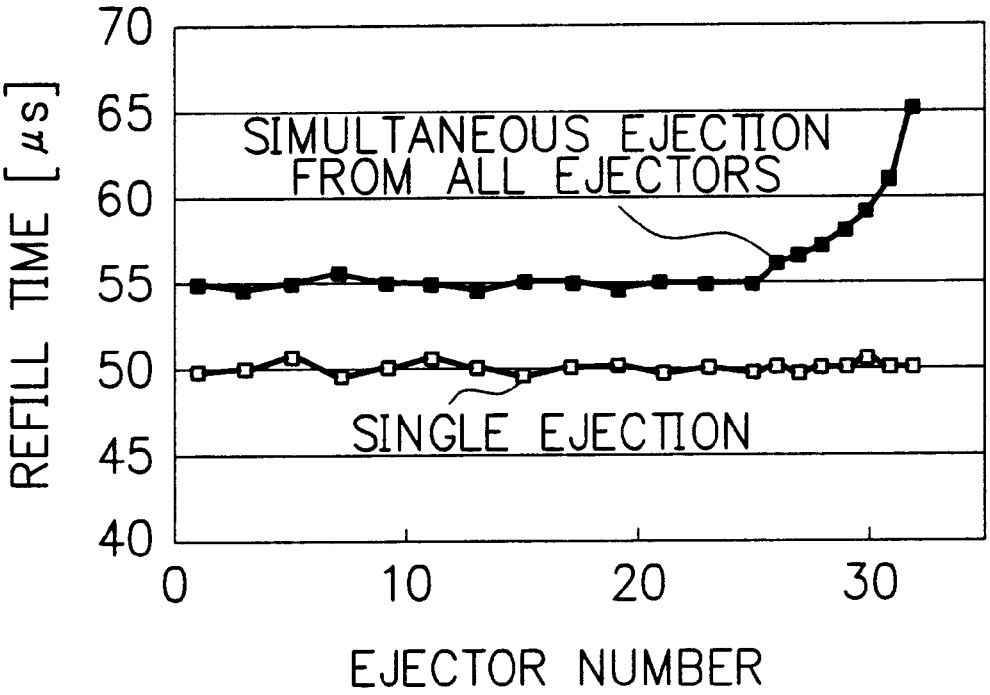
FIG. 6 (PRIOR ART)
FIG. 6 is a graph showing an experimental result of refill time of the conventional multi-nozzle ink jet printing head of FIG. 5.
Figure 7A:
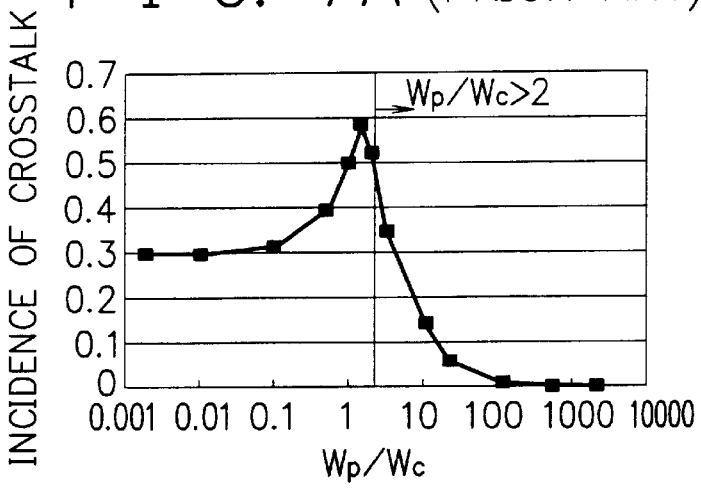
FIG. 7A (PRIOR ART)
FIG. 7A is a graph showing the change of the incidence of crosstalk that was observed when the ratio between the capacity Wp of the common ink channel and the total capacity Wc of the pressure generation chambers (including nearby channels) was changed in the conventional multi-nozzle ink jet printing head of FIG. 5.
Figure 7B:
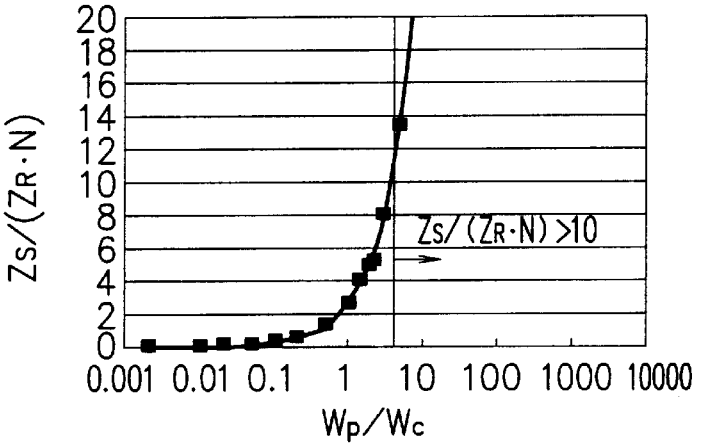
FIG. 7B (PRIOR ART)
FIG. 7B is a graph showing the change of the ratio ($Z_S/(Z_R \cdot N)$) between supply channel impedance $Z_S$ and common ink channel impedance $Z_R$ that was observed when the ratio Wp/Wc was changed in the ink jet printing head of FIG. 5.
Figure 14:
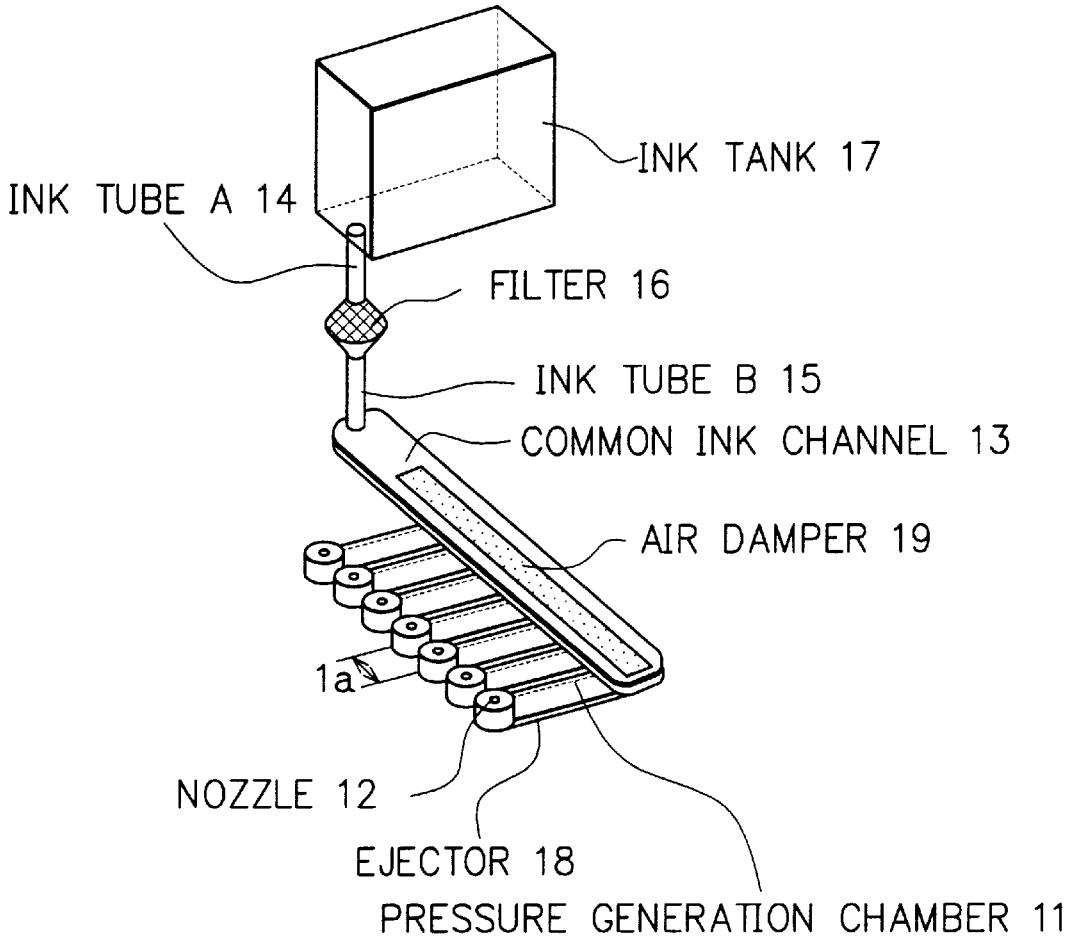
FIG. 14 is a schematic diagram showing an ink jet printing head in accordance with a first embodiment of the present invention.

FIG. 14 is a schematic diagram showing an ink jet printing head in accordance with a first embodiment of the present invention. The ink jet printing head of this embodiment has almost the same basic composition as the conventional ink jet printing head of FIGS. 1 and 5.

The head is typically manufactured by stacking up a plurality of thin plates (films) having perforations (made by etching etc.) with adhesives and thereby bonding them together. In this embodiment, stainless steel films (thickness: 50~75 μm) are bonded together by use of thermosetting resin adhesive layers (thickness: approx. 5 μm).

The ink jet printing head of the embodiment is provided with thirty-two ejectors 18 which are connected together by a common ink channel 13. Incidentally, only seven ejectors 18 are shown in FIG. 14 for the sake of simplicity. The common ink channel 13 is connected to an ink tank 17 via an ink tube B 15, a filter 16 and an ink tube A 14. The parts cooperate so as to guide the ink into pressure generation chambers 11. In other words, in the ink jet printing head of this embodiment, an ink supply system is formed by the common ink channel 13, the ink tube B 15, the filter 16, the ink tube A 14 and the ink tank 17.

In the following, cross-sectional structure of each ejector 18 will be explained referring to FIG. 1. Each pressure generation chamber 121, being connected with the common ink channel 123 via an ink supply channel 124, is packed with ink. In this embodiment, ink having viscosity of 3 mPa•s and surface tension of 35 mN/m was used. Acoustic capacitance $C_c$ of the pressure generation chamber can be expressed as:

$$C_c = \frac{W_C}{\kappa K} \tag{3}$$

where "W" denotes the capacity [$m^3$] of the pressure generation chamber, "κ" denotes the elastic constant [Pa]0 of the ink, and "K" denotes a correction factor that depends on the rigidity etc. of the pressure generation chamber.

In this embodiment, the capacity of the pressure generation chamber is $6.0\times10^{-11}$ $m^3$ and the elastic constant of the ink is $2.2\times10^9$ Pa. The correction factor K was obtained as 0.3 based on an experimental evaluation. Therefore, the acoustic capacitance $C_c$ of the pressure generation chamber is estimated as $9.1\times10^{-20}$ $m^5/N$.

Each pressure generation chamber 121 is provided with a nozzle 122 for ejecting ink drops. In this embodiment, the diameter of the opening of the nozzle 122 having a tapered shape was 30 μm and the length was 65 μm.

Figure 3:
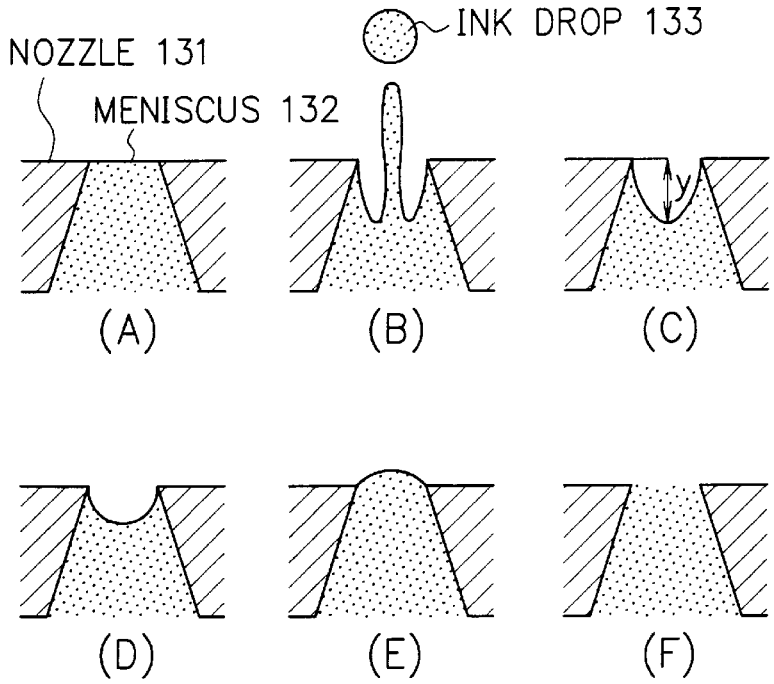
FIG. 3 (PRIOR ART)
FIG. 3 is a schematic diagram showing the action of a meniscus in a nozzle when the ink drop ejection is carried out.
Figure 4:
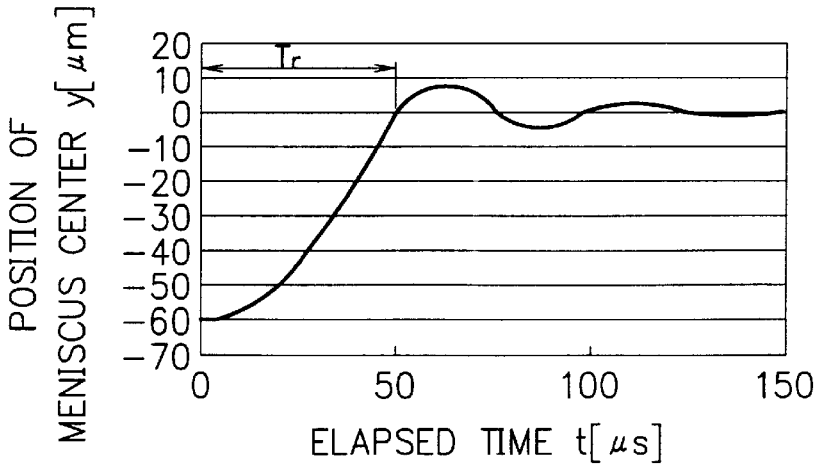
FIG. 4 (PRIOR ART)
FIG. 4 is a graph showing the change of position of the meniscus when the ink drop ejection is carried out.

If we describe the nozzle opening diameter as "$d_n$" [m], surface tension of the ink as "σ" [N/m], and the withdrawing length of the meniscus (shown in (C) of FIG. 3) as "y" [m], the acoustic capacitance $C_n$ of the nozzle can be approximated as follows.

$$C_n = \frac{\pi d_n^4}{64\sigma}\sqrt{1+\frac{16y^2}{d_n^2}} \tag{4}$$

As shown in the above equation (4), the acoustic capacitance $C_n$ of the nozzle depends on the withdrawing length y of the meniscus. Here, $C_n$ is estimated as follows using a typical value $y=d_n/4$.

$$C_n = \frac{\pi d_n^4}{48\sigma} \tag{5}$$

The nozzle opening diameter $d_n$ is 30 μm and the ink surface tension σ is 35 mN/m in this embodiment, therefore, the acoustic capacitance $C_n$ of the nozzle is estimated as $1.5\times10^{-18}$ $m^5/N$.

To the bottom of the pressure generation chamber 121, a vibration plate 125 is provided. A piezoelectric actuator 126 (piezoelectric vibrator), which is provided outside the pressure generation chamber 121 as pressure generation means, enables expansion and contraction of the pressure generation chamber 121. In this embodiment, the vibration plate 125 was implemented by a thin nickel plate which was formed by electroforming.

The piezoelectric actuator 126 was implemented by multilayered piezoelectric ceramics. The piezoelectric actuator 126 is driven by a driving circuit. When the volume (capacity) of the pressure generation chamber 121 is changed by the piezoelectric actuator 126 driven by the driving circuit, a pressure wave is generated in the pressure generation chamber 121. The ink in the nozzle 122 is pushed by the pressure wave and is discharged outward, thereby an ink drop 127 is formed and ejected from the nozzle 122.

In the ink jet printing head of the embodiment, the width, height and total length ($l_p$) of the common ink channel 13 connecting the thirty-two ejectors together were set to 2.5 mm, 250 μm and 25 mm, respectively. The inertance $m_p$ and acoustic resistance $r_p$ of the common ink channel is calculated as $4.0\times10^7$ $kg/m^4$ *and* $4.5\times10^{10}$ $Ns/m^5$, respectively.

On the upper surface of the common ink channel 13, an air damper 19 made of a polyimide film is attached as pressure damping means. The thickness and width of the air damper 19 were 75 $\mu$m and 1.2 mm. When the air damper 19 has beam structure that is held by its ends, the acoustic capacitance $C_d$ of the air damper 19 can be approximated as follows.

$$C_d = \frac{l_d W_d^5 (1 - V_d^2)}{60 E_d t_d^3} \tag{6}$$

where "$W_d$", "$t_d$", "$l_d$", "$E_d$" and "$v_d$" denote the width [m], thickness [m], length [m], elastic constant [Pa] and Poisson's ratio of the air damper 19.

In this embodiment, the distance between ejectors (=$l_d$) was 0.6 mm, and the elastic constant and Poisson's ratio of polyimide which was used for the air damper 19 were 2.0 GPa and 0.4. Therefore, the acoustic capacitance $C_d$ of the air damper 19 per ejector is calculated as $2.5\times10^{-17}$ $m^5/N$. Incidentally, in the ink jet printing head of this embodiment, the acoustic capacitance $C_p$ of the common ink channel 13 can be regarded to be almost equal to the acoustic capacitance $C_d$ of the air damper 19, therefore, $C_p$ will hereafter be assumed to be equal to $C_d$ ($C_p$=$C_d$).

From the above calculations, the acoustic capacitance $C_p$ of the common ink channel 13 of the ink jet printing head of this embodiment almost amounts to $17\times C_n$ and $275\times C_c$, thereby the two conditions $C_p>10C_n$ and $C_p>20C_c$ are both satisfied.

Figure 15:
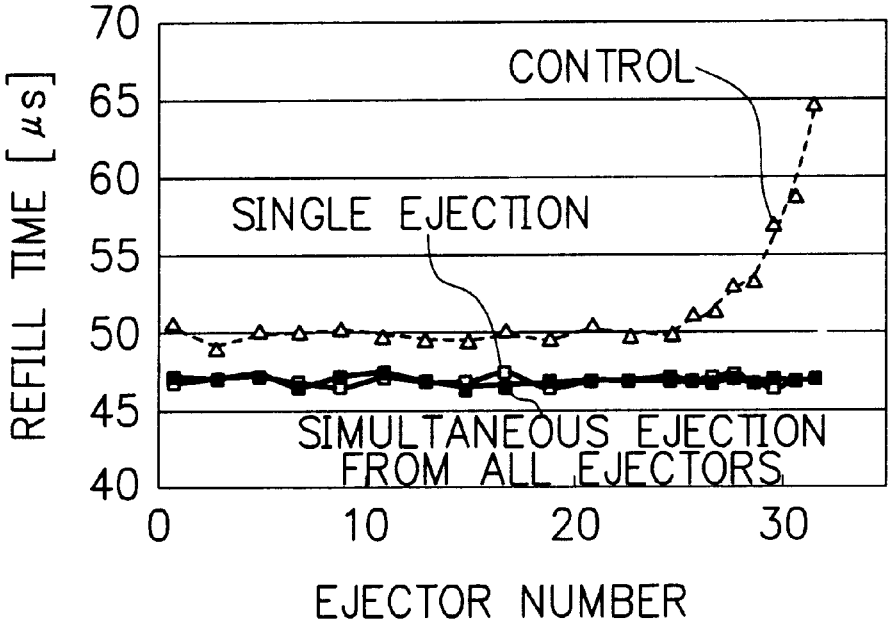
FIG. 15 is a graph showing the refill time of each ejector of the ink jet printing head of the first embodiment.

FIG. 15 is a graph showing the refill time of each ejector of the ink jet printing head of the first embodiment. The ejection evaluation of FIG. 15 was conducted by changing the ejection frequency and the number of simultaneously ejecting ejectors. Open circles (○) in FIG. 15 denote the refill time of each ejector of the ink jet printing head of this embodiment in the single (separate) ink drop ejection, and filled squares (■) denote the refill time of each ejector in the simultaneous ink drop ejection. The variation of refill time between nozzles was within 2 $\mu$s both in the single ink drop ejection (○) and the simultaneous ink drop ejection (■). The increase of refill time and the refill time variation between ejectors due to the simultaneous ink drop ejection could be eliminated almost perfectly.

Thanks to the elimination of the increase of refill time, simultaneous ink drop ejection from all the ejectors could be carried out stably at a frequency of as high as 20 kHz. The difference of ink drop speed between the single ink drop ejection (○) and the simultaneous ink drop ejection (■) was within ±2% in each ejector. The crosstalk between ejectors could be eliminated successfully.

As a control group, a similar ejection evaluation was conducted with regard to a conventional ink jet printing head having an air damper 19 which was formed of a stainless steel film of a thickness of 35 $\mu$m. Open triangles (Δ) in FIG. 15 denote the refill time of each ejector of the conventional ink jet printing head. In the head, the acoustic capacitance $C_p$ of the common ink channel was $2.7\times10^{-18}$ $m^5/N$. Therefore, $C_p=1.8C_n$ and $C_p=30C_c$ hold. By the values $C_p$, $C_n$ and $C_c$, the condition $C_p>20C_c$ is satisfied, however, the other condition $C_p>10C_n$ is not satisfied.

In the ejection evaluation, the conventional ink jet printing head could avoid the crosstalk, however refill time variation between nozzles up to 15 $\mu$s was observed. When the simultaneous ink drop ejection from all the nozzles was forcibly carried out at 20 kHz, instability or malfunction of ink drop ejection was observed at ejectors near the distal end of the common ink channel.

Incidentally, the conventional ink jet printing head experimentally produced by the present inventors as the control group fulfills the aforementioned conditions of the prior arts #1 and #2, which means that stable high-frequency ink drop ejection can not be realized even if the characteristics of the common ink channel are set according to the prior arts. The above results indicate that stable simultaneous ink drop ejection from all the nozzles can be realized only when the acoustic capacitance $C_p$ of the common ink channel is set optimally based on the acoustic capacitance $C_n$ of the nozzle and the acoustic capacitance $C_c$ of the pressure generation chamber.

Embodiment 2

Figure 16:
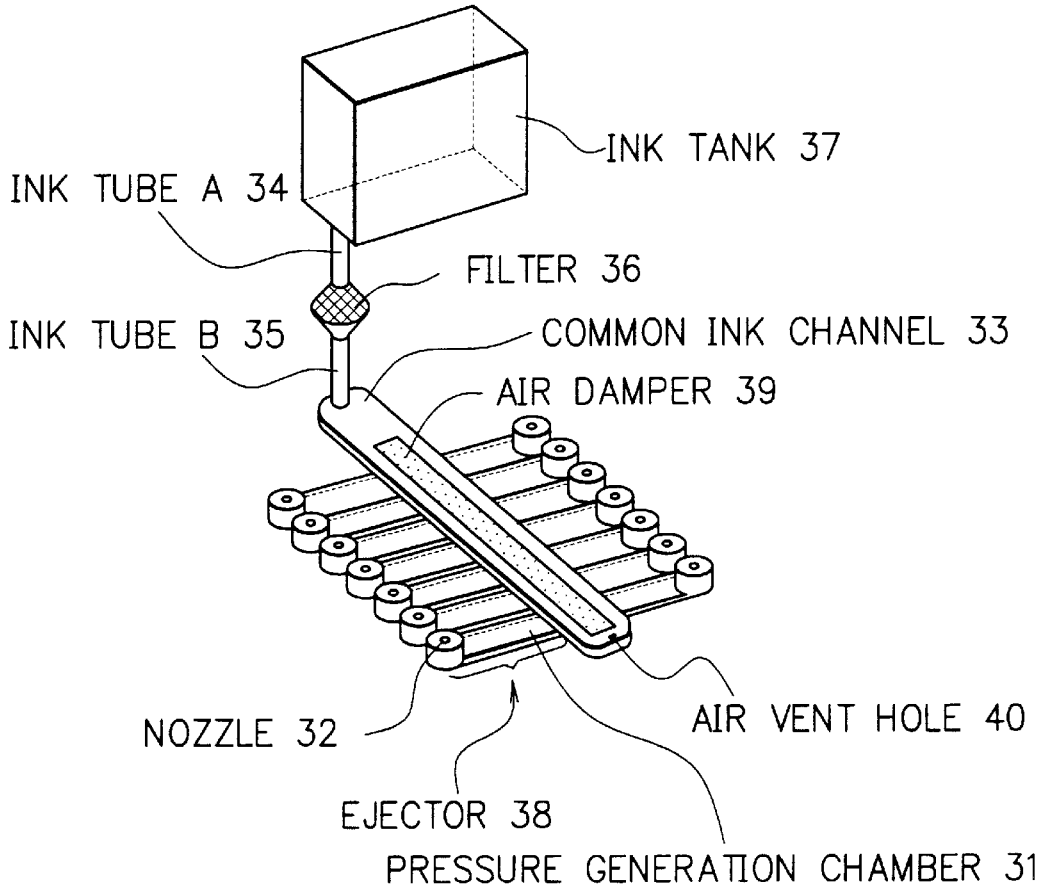
FIG. 16 is a schematic diagram showing an ink jet printing head in accordance with a second embodiment of the present invention.

FIG. 16 is a schematic diagram showing an ink jet printing head in accordance with a second embodiment of the present invention. The ink jet printing head of the second embodiment has almost the same basic composition as the first embodiment which has been described above. In the second embodiment, ejectors 38 are placed on both sides of the common ink channel 33. Therefore, the number of ejectors is doubled to 64 (only fourteen ejectors 38 are shown in FIG. 16 for the sake of simplicity). The ejectors 38 are connected to the common ink channel 33 avoiding a distal end area of the common ink channel 33. When the number of ejectors connected to the common ink channel 33 increases as in this embodiment, ensuring enough acoustic capacitance $C_p$ per ejector becomes difficult and thereby the refill time tends to increase.

In the ink jet printing head of the second embodiment, the air damper was formed of polyimide. The thickness, width, and length ($l_d$) of the air damper are 50 $\mu$m, 1 mm and 0.3 mm respectively, thereby an acoustic capacitance $C_p=1.7\times10^{-17}$ $m^5/N$ is ensured. The acoustic capacitance $C_n$ of the nozzle 32 and the acoustic capacitance $C_c$ of the pressure generation chamber 31 are the same as those of the, first embodiment. Therefore, the two conditions $C_p>10C_n$ and $C_p>20C_c$ are also satisfied by the ink jet printing head of the second embodiment.

In the second embodiment, the distal end area to which no ejector is connected is provided to the common ink channel 33 since ensuring enough acoustic capacitance becomes difficult near the distal end of the common ink channel 33 due to the increase of deformation restriction etc. of the air damper in the distal end area. By the provision of the distal end area to which no ejector is connected, ejectors near the distal end area are allowed to have enough acoustic capacitance $C_p$. Consequently, the necessity of setting the rigidity of the air damper very low can be avoided, thereby the manufacturing method of the head can be simplified and the manufacturing cost can be reduced.

Incidentally, due to the removal of ejectors from the distal end area of the common ink channel, there may be cases where bubbles remain in the distal end area. Therefore, in the second embodiment, an air vent hole 40 is provided to the distal end of the common ink channel so that the bubbles can be removed easily. It is of course possible to employ other structure for the removal of bubbles. For example, a channel for bleeding the bubbles can be connected to the distal end.

As mentioned before, the crosstalk and the increase of refill time in the simultaneous ink drop ejection tend to occur near the distal end of the common ink channel. The two conditions $C_p>10C_n$ and $C_p>20C_c$ can eliminate the crosstalk and the increase of refill time even in the distal end area.

Meanwhile, around the proximal end of the common ink channel (near the ink tube B 35), the crosstalk and the increase of refill time hardly occur. Therefore, the two conditions $C_p>10C_n$ and $C_p>20C_c$ are not necessarily required in the proximal end area. In other words, the crosstalk and the increase of refill time can be eliminated by setting the acoustic capacitance $C_p$ so as to satisfy the two conditions $C_p>10C_n$ and $C_p>20C_c$ only in an area where the crosstalk and the increase of refill time tend to occur.

When the present inventors made an ejection evaluation of the ink jet printing head of the second embodiment, the incidence of crosstalk was less than 2% and the refill time variation between nozzles was 3 μs at most. Therefore, the simultaneous ink drop ejection from all the ejectors could be carried out with stability at an ejection frequency of 20 kHz.

As described above, by setting the acoustic capacitance $C_p$ so as to satisfy the two conditions $C_p>10C_n$ and $C_p>20C_c$, stable high-frequency driving of the head can be realized even if the number of ejectors connected to the common ink channel is increased. Therefore, an ink jet printing head having very high printing speed can be realized.

Embodiment 3

Figure 17:
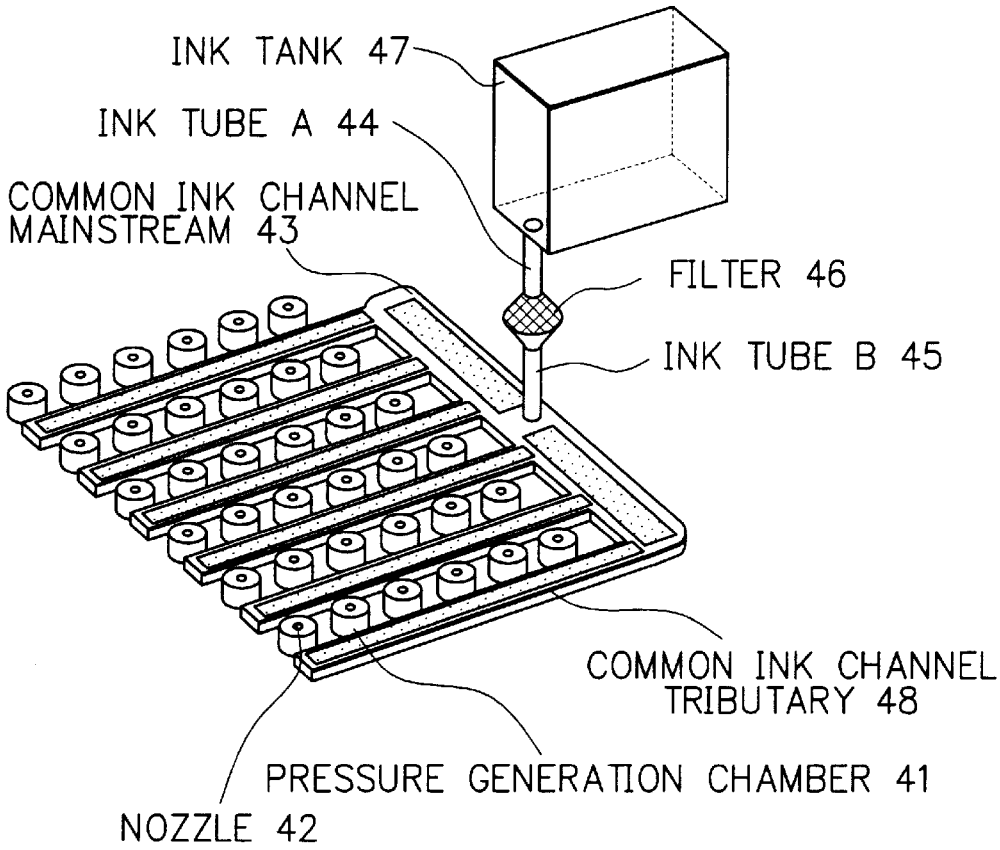
FIG. 17 is a schematic diagram showing an ink jet printing head in accordance with a third embodiment of the present invention.

FIG. 17 is a schematic diagram showing an ink jet printing head in accordance with a third embodiment of the present invention. The composition of the head of FIG. 17 from the ink tank 47 to the ink tube B 45 is the same as that of the first embodiment. In the third embodiment, the common ink channel is composed of a mainstream 43 and tributaries 48, and the ejectors for ejecting ink drops are arranged in a two-dimensional matrix of rows and columns.

By the two-dimensional arrangement, the ejectors can be placed in high packing density and thereby the number of ejectors of the head can be increased efficiently. In the third embodiment, the number of the common ink channel tributaries 48 are set to 24 and 8 ejectors are connected to each tributary 48, thereby 192 ejectors are arranged in the two-dimensional matrix (only 32 ejectors are shown in FIG. 17 for the sake of simplicity). When such two-dimensional ejector arrangement is employed, the need of ensuring enough acoustic capacitance arises for both the mainstream 43 and tributaries 48 of the common ink channel.

In the ink jet printing head of the second embodiment, the common ink channel mainstream 43 was provided with an air damper having a width of 1.5 mm and a thickness of 75 μm, and each common ink channel tributary 48 was provided with an air damper having a width of 0.6 mm and a thickness of 50 μm, thereby acoustic capacitance of $C_p=1.9\times10^{-16}$ $m^5/N$ could be ensured for the mainstream 43 and acoustic capacitance of $C_p=2.6\times10^{-18}$ $m^5/N$ could be ensured for each tributary 48.

Incidentally, an air damper of a thickness of 25 μm was specially provided to a distal end part of each tributary 48, thereby acoustic capacitance of $C_p=2.1-10^{-17}$ $m^5/N$ was ensured for the distal end part. By setting the acoustic capacitance $C_p$ so as to increase at the distal end part of the common ink channel tributary 48, enough acoustic capacitance can be ensured without the need of unduly stretching the length of the common ink channel. Therefore, such setting is effective for miniaturizing the head and increasing the density of ejectors arranged in the head.

Incidentally, in order to increase the acoustic capacitance at the distal end part of the common ink channel tributary 48, methods other than the above method (decreasing the thickness of the air damper) can be employed. For example, the acoustic capacitance can be increased by providing grooves to the air damper and thereby raising deformability of the air damper.

In an ejection evaluation conducted for the ink jet printing head of the third embodiment, the incidence of crosstalk was 3% or less and the refill time variation between nozzles was 3 μs at the maximum. The simultaneous ink drop ejection from all the ejectors could be carried out successfully at 20 kHz.

As above, by setting the acoustic capacitance $C_p$ of the common ink channel so as to satisfy the two conditions $C_p>10C_n$ and $C_p>20C_c$, the crosstalk and the increase of refill time can be avoided and stable high-frequency simultaneous ink drop ejection can be carried out even when a large number of ejectors are connected to the common ink channel by the employment of the two-dimensional ejector arrangement. Incidentally, if ink drops of diameters of approximately 25 pl are ejected by 192 ejectors at an ejection frequency of 20 kHz, printing of A4 size papers can be carried out at a speed of 18 sheets/minute, therefore, extremely high printing speed can be realized by the third embodiment.

The ink jet printing heads of the above embodiments can be applied to a variety of ink jet printing devices (ink jet printers, facsimile machines, etc.). The types of the ink jet printing devices are not particularly limited. By the employment of the ink jet printing heads of the present invention, high-speed and high-quality printing can be realized.

As set forth hereinabove, by the ink jet printing heads and the ink jet printing devices in accordance with the present invention, the crosstalk between ejectors which are connected together by the common ink channel, the increase of refill time, and the refill time variation between nozzles in the simultaneous ink drop ejection can be eliminated efficiently, thereby stable high-frequency ink drop ejection is made possible even when a large number of ejectors are connected to the common ink channel, thereby high-speed and high-quality printing is realized.

While the present invention has been described with reference to the particular illustrative embodiments, it is not to be restricted by those embodiments but only by the appended claims.

For example, while piezoelectric actuators were employed as the pressure generation means in the above embodiments, other pressure generation means such as electromechanical transducers employing electrostatic force and magnetic force, electrothermal transducers for generating pressure by use of boiling of liquid, etc. can also be employed.

The piezoelectric actuator as the pressure generation means is not limited to the multilayered piezoelectric actuator (longitudinal vibration mode) which has been employed in the above embodiments. Other types of actuators such as a single plate piezoelectric actuator for changing the volume of the pressure generation chamber by its bending can also be employed as the pressure generation means.

While Kyser-type ink jet printing heads as shown in FIG. 1 were employed in the above embodiments, the present invention can also be applied to ink jet printing heads of other types, such as an ink jet printing head whose pressure-generation chambers are implemented by grooves that are provided to piezoelectric actuators.

While an ink jet printer which ejects coloring ink to paper and thereby prints letters, images, etc. has been taken as an example of the ink jet printing device in the above embodiments, the term "ink jet printing" is not limited to the printing of letters, images, etc. on paper by use of ink. The medium to which the printing is carried out is not limited to paper but can be a polymer film, glass, etc. Therefore, the present invention can also be applied to the manufacture of color filters of display devices, etc. Further, the liquid (ink) which is ejected by the ejectors is not limited to coloring ink, therefore, the present invention can also be applied to ink jet printing devices for ejecting melted solder and thereby forming solder bumps (for the mounting of parts) on circuit boards. The present invention can generally be applied to various types of liquid ejection devices for industrial use. Therefore, the term "ink jet printing device" in this document denotes such a liquid ejection device.

The term "simultaneous ink drop ejection" in which the present invention exhibits a high degree of effectiveness is not restricted to the simultaneous ink drop ejection from all the ejectors but various types of quasi-simultaneous ink drop ejection patterns (slightly shifting ejection timing between ejectors, for example) are included in the term "simultaneous ink drop ejection". The present invention can widely be applied to a variety of simultaneous ink drop ejection.

While an air damper was employed in the above embodiments as the pressure damping means in the common ink channel, other types of pressure damping means are also possible. For example, the pressure damping means can also be implemented by inserting a pressure absorber having a low elastic constant in the common ink channel, intentionally storing bubbles in the common ink channel, etc.

It is to be appreciated that those skilled in the art can change or modify the embodiments without departing from the scope and spirit of the present invention.

What is claimed is:

1. An ink jet printing head comprising:

a plurality of ejectors each of which at least includes a pressure generation chamber, a nozzle which is connected with the pressure generation chamber, and pressure generation means for generating pressure in the pressure generation chamber; and an ink supply system which at least includes a common ink channel to which the ejectors are connected, and forming letters, image patterns, etc. on a medium by ejecting ink drops from the nozzles by letting the pressure generation means cause change of pressure in the pressure generation chambers which are filled with ink supplied from the common ink channel, wherein:

acoustic capacitance $C_p$ of the common ink channel per ejector is set based on acoustic capacitance $C_n$ of the nozzle and acoustic capacitance $C_c$ of the pressure generation chamber.

2. An ink jet printing head as claimed in claim 1, wherein the acoustic capacitance $C_p$ of the common ink channel per ejector is set so as to satisfy a condition $C_p>10\ C_n$.

3. An ink jet printing head as claimed in claim 1, wherein the acoustic capacitance $C_p$ of the common ink channel per ejector is set so as to satisfy a condition $C_p>20\ C_c$.

4. An ink jet printing head as claimed in claim 1, wherein the acoustic capacitance $C_p$ of the common ink channel per ejector is set so as to satisfy conditions $C_p>10\ C_n$ and $C_p>20\ C_c$.

5. An ink jet printing head as claimed in claim 1, wherein the common ink channel is provided with pressure damping means for damping pressure therein.

6. An ink jet printing head as claimed in claim 5, wherein the pressure damping means is implemented by a resin film.

7. An ink jet printing head as claimed in claim 6, wherein the pressure damping means is implemented by a polyimide film.

8. An ink jet printing head as claimed in claim 5, wherein the pressure damping means is formed so that its acoustic capacitance will get larger at the distal end of the common ink channel.

9. An ink jet printing head as claimed in claim 8, wherein the thickness of the pressure damping means is decreased at the distal end of the common ink channel.

10. An ink jet printing head as claimed in claim 8, wherein grooves are provided to the pressure damping means at the distal end of the common ink channel.

11. An ink jet printing head as claimed in claim 1, wherein an area to which no ejector is connected is provided to the distal end of the common ink channel.

12. An ink jet printing head as claimed in claim 11, wherein a hole or channel for bleeding bubbles is provided to the distal end of the common ink channel.

13. An ink jet printing head as claimed in claim 1, wherein the ejectors are arranged in a two-dimensional matrix.

14. An ink jet printing head as claimed in claim 13, wherein the common ink channel includes:

a common ink channel mainstream as the upstream side of the common ink channel; and a plurality of common ink channel tributaries which are connected to the common ink channel mainstream as the downstream side of the common ink channel, to each of which a plurality of ejectors are provided.

15. An ink jet printing device employing an ink jet printing head that comprises:

a plurality of ejectors each of which at least includes a pressure generation chamber, a nozzle which is connected with the pressure generation chamber, and pressure generation means for generating pressure in the pressure generation chamber; and an ink supply system which at least includes a common ink channel to which the ejectors are connected, and that forms letters, image patterns, etc. on a medium by ejecting ink drops from the nozzles by letting the pressure generation means cause change of pressure in the pressure generation chambers which are filled with ink supplied from the common ink channel, wherein:

acoustic capacitance $C_p$ of the common ink channel per ejector is set based on acoustic capacitance $C_n$ of the nozzle and acoustic capacitance $C_c$ of the pressure generation chamber.

16. An ink jet printing device as claimed in claim 15, wherein the acoustic capacitance $C_p$ of the common ink channel per ejector is set so as to satisfy a condition $C_p>10\ C_n$.

17. An ink jet printing device as claimed in claim 15, wherein the acoustic capacitance $C_p$ of the common ink channel per ejector is set so as to satisfy a condition $C_p>20\ C_c$.

18. An ink jet printing device as claimed in claim 15, wherein the acoustic capacitance $C_p$ of the common ink channel per ejector is set so as to satisfy conditions $C_p>10\ C_n$ and $C_p>20\ C_c$.

19. An ink jet printing device as claimed in claim 15, wherein the common ink channel is provided with pressure damping means for damping pressure therein.

20. An ink jet printing device as claimed in claim 19, wherein the pressure damping means is implemented by a resin film.

21. An ink jet printing device as claimed in claim 20, wherein the pressure damping means is implemented by a polyimide film.

22. An ink jet printing device as claimed in claim 19, wherein the pressure damping means is formed so that its acoustic capacitance will get larger at the distal end of the common ink channel.

23. An ink jet printing device as claimed in claim 22, wherein the thickness of the pressure damping means is decreased at the distal end of the common ink channel.

24. An ink jet printing device as claimed in claim 22, wherein grooves are provided to the pressure damping means at the distal end of the common ink channel.

25. An ink jet printing device as claimed in claim 15, wherein an area to which no ejector is connected is provided to the distal end of the common ink channel.

26. An ink jet printing device as claimed in claim 25, wherein a hole or channel for bleeding bubbles is provided to the distal end of the common ink channel.

27. An ink jet printing device as claimed in claim 15, wherein the ejectors are arranged in a two-dimensional matrix.

28. An ink jet printing device as claimed in claim 27, wherein the common ink channel includes:

a common ink channel mainstream as the upstream side of the common ink channel; and a plurality of common ink channel tributaries which are connected to the common ink channel mainstream as the downstream side of the common ink channel, to each of which a plurality of ejectors are provided.

* * * * *